US005445711A

United States Patent [19]

Tanski et al.

[11] Patent Number: 5,445,711

[45] Date of Patent: Aug. 29, 1995

[54] LOW RESISTANCE, THERMALLY STABLE ELECTRODE STRUCTURE FOR ELECTROLUMINESCENT DISPLAYS

[75] Inventors: William J. Tanski, Glastonbury; Roger Carroll, Willimantic; Emilio J. Branciforte, Cromwell, all of Conn.

[73] Assignee: Westinghouse Norden Systems, Norwalk, Conn.

[21] Appl. No.: 250,969

[22] Filed: May 31, 1994

Related U.S. Application Data

[62] Division of Ser. No. 897,201, Jun. 11, 1992.

[51] Int. Cl.[6] ..... B44C 1/22; C23F 1/02

[52] U.S. Cl. ..... 216/13; 216/51; 216/101; 252/79.2; 437/181

[58] Field of Search ..... 156/634, 656, 659.1, 156/667, 901, 902; 252/79.2; 427/66; 437/181

[56] References Cited

U.S. PATENT DOCUMENTS

| | | | |
|---|---|---|---|
| 4,066,925 | 1/1978 | Dickson | 313/503 |
| 4,624,737 | 11/1986 | Shimbo | 156/643 |
| 4,670,097 | 6/1987 | Abdalla et al. | 156/659.1 |
| 4,693,906 | 9/1987 | Lindmayer | 427/69 |
| 4,719,152 | 1/1988 | Ohta et al. | 428/432 |
| 4,736,229 | 4/1988 | Holmberg et al. | 357/54 |
| 4,894,116 | 1/1990 | Barrow et al. | 156/656 X |
| 5,057,244 | 10/1991 | Nitta et al. | 252/501.1 |

FOREIGN PATENT DOCUMENTS 1134895 5/1989 Japan .

OTHER PUBLICATIONS

W. Barrow, et al., A 9 Inch Diagonal High-Contrast Multicolor Display, Digest of Technical Papers, May 1992, pp. 348-351.

O. J. Gregory et al., Fabrication of High Conductivity, Transparent Electrodes With Trenched Metal Bus Lines, J. Electrochem Soc. vol. 138, No. 7.

*Primary Examiner*—William Powell

*Attorney, Agent, or Firm*—C. O. Edwards

[57] ABSTRACT

An electroluminescent display includes a transparent electrode (4) and a metal assist structure (6) formed over a portion of the transparent electrode (6) such that the metal assist structure (6) is in electrical contact with the transparent electrode (4). The metal assist structure (6) includes a first refractory metal layer (10), a primary conductor layer (12) formed on the first refractory metal layer (10), and a second refractory metal layer (14) formed on the primary conductor layer (12). The first and second refractory metal layers (10, 14) are capable of protecting the primary conductor layer (12) from oxidation when the electroluminescent display is annealed to activate a phosphor layer (18). In an alternate embodiment, an electroluminescent display includes a substrate (2) and a metal electrode (22) formed on the substrate (2). The metal electrode (22) includes a first refractory metal layer (10), a primary conductor layer (12) formed on the first refractory metal layer (10), and a second refractory metal layer (14) formed on the primary conductor layer (12).

24 Claims, 3 Drawing Sheets

LOW RESISTANCE, THERMALLY STABLE ELECTRODE STRUCTURE FOR ELECTROLUMINESCENT DISPLAYS

This invention was made with Government support under contract number MDA972-90-C-0069 awarded by the Defense Advanced Research Projects Agency. The Government has certain rights in this invention.

This a division of copending application Ser. No. 7/897,201 filed on Jun. 11, 1992.

TECHNICAL FIELD

The present invention is directed to an electrode structure for electroluminescent displays.

BACKGROUND ART

Electroluminescent display panels (ELDs) offer several advantages over older display technologies such as cathode ray tubes (CRTs) and liquid crystal displays (LCDs). Compared with CRTs, ELDs require less power, provide a larger viewing angle, and are much thinner. Compared with LCDs, ELDs have a larger viewing angle, brighter display, do not require auxiliary lighting, and can have a larger display area.

FIG. 1 shows a typical prior art ELD. The ELD has a glass panel 2, a plurality of transparent electrodes 4, a first layer of a dielectric 16, a phosphor layer 18, a second dielectric layer 20, and a plurality of metal electrodes 22 perpendicular to the transparent electrodes 4. The transparent electrodes, 4 are typically indium-tin oxide (ITO) and the metal electrodes 22 are typically Al. The dielectric layers 16, 20 act as capacitors to protect the phosphor layer 18 from excessive currents. When an electrical potential, such as about 200V, is applied between the transparent electrodes 4 and the metal electrodes 22, electrons tunnel from one of the interfaces between the dielectric layers 16, 20 and the phosphor layer 18 into the phosphor layer where they are rapidly accelerated. The phosphor layer 18 typically comprises ZnS doped with Mn. Electrons entering the phosphor layer 18 excite the Mn and the Mn emits photons. The photons pass through the first dielectric layer 16, the transparent electrodes 4, and the glass panel 2 to form a visible image.

Although current ELDs are satisfactory for some applications, more advanced applications require brighter displays, larger displays, or smaller displays. These applications require electrodes with lower resistances than available in current ELDs. The limiting factor in current ELDs is the high resistance, about 10 ohms/square (Ω/□), of transparent electrodes made from ITO. Therefore, what is needed in the industry are lower resistance transparent electrodes for ELDs.

DISCLOSURE OF THE INVENTION

The present invention is directed to lower resistance transparent electrodes for electroluminescent displays.

One aspect of the invention includes an electroluminescent display that has a transparent electrode and a metal assist structure formed over a portion of the transparent electrode such that the metal assist structure is in electrical contact with the transparent electrode. The metal assist structure comprises a first refractory metal layer, a primary conductor layer formed on the first refractory metal layer, and a second refractory metal layer formed on the primary conductor layer. The first and second refractory metal layers are capable of protecting the primary conductor layer from oxidation when the electroluminescent display is annealed to activate a phosphor layer.

Another aspect of the invention includes an electroluminescent display that has a substrate and a metal electrode formed on the substrate. The metal electrode comprises a first refractory metal layer, a primary conductor layer formed on the first refractory metal layer, and a second refractory metal layer formed on the primary conductor layer. The first and second refractory metal layers are capable of protecting the primary conductor layer from oxidation when the electroluminescent display is annealed to activate a phosphor layer.

Another aspect of the invention includes a method of making an electroluminescent display by forming the metal assist structure described above over a transparent electrode.

Another aspect of the invention includes a method of making an electroluminescent display by forming the metal electrode described above over a substrate.

These and other features and advantages of the present invention will become more apparent from the following description and accompanying drawing.

BEST MODE FOR CARRYING OUT THE INVENTION

Figure 1:
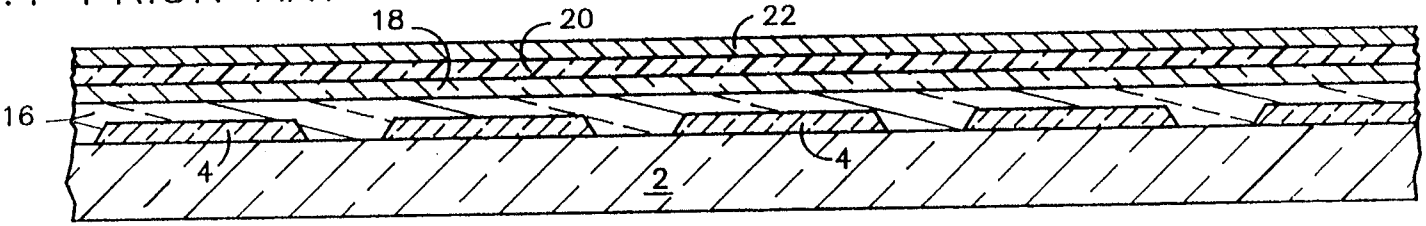
FIG. 1 PRIOR ART
FIG. 1 is a cross-sectional view of a typical prior art ELD.
Figure 2:
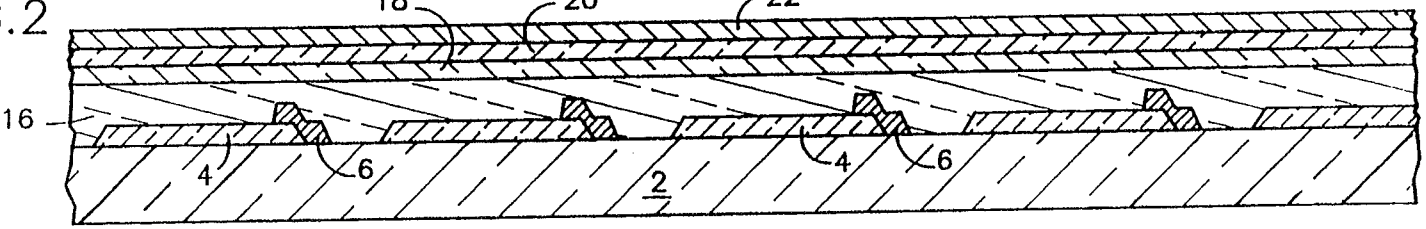
FIG. 2 is a cross-sectional view of an ELD of the present invention.

In one embodiment of the present invention, the metal assist structure significantly reduces the resistance of transparent electrodes in an electroluminescent display panel (ELD) by providing a low resistance path for electrical current. As shown in FIG. 2, the metal assist structure 6 should be in electrical contact with a transparent electrode 4 and should extend for the entire length of the electrode. The metal assist structure 6 can comprise one or more layers of an electrically conductive metal compatible with the transparent electrode 4 and other structures in the ELD. To decrease the amount of light transmissive area covered by the metal assist structure 6, the metal assist structure should cover only a small portion of the transparent electrode 4. For example, the metal assist structure 6 can cover about 10% or less of the transparent electrode 4. Therefore, for a typical transparent electrode 4 that is about 250 μm (10 mils) wide, the metal assist structure 6 should overlap the transparent electrode by about 25 μm (1 mill) or less. Overlaps as small as about 6 μm (0.25 mils) to about 13 μm (0.5 mils) are be desirable. Although the metal assist structure 6 should overlap the transparent electrode 4 as little as possible, the metal assist structure should be as wide as practical to decrease electrical resistance. For example, a metal assist structure 6 that is about 50 μm (2 mils) to about 75 μm (3 mils) wide may be desirable. These two design parameters can be satisfied by allowing the metal assist structure 6 to overlap the glass panel 2 as well as the transparent electrode 4. With current fabrication methods, the thickness of the metal assist structure 6 should be equal to or less than the thickness of the first dielectric layer 16 to ensure that the dielectric layer 16 adequately covers the transparent electrode 4 and metal assist structure. For example, the metal assist structure 6 can be less than about 250 nm thick. Preferably, the metal assist structure 6 will be less than about 200 nm thick, such as between about 150 nm and about 200 nm thick. As fabrication methods improve, however, it may become practical to make metal assist structures 6 thicker than the first dielectric layer 16.

Figure 3:
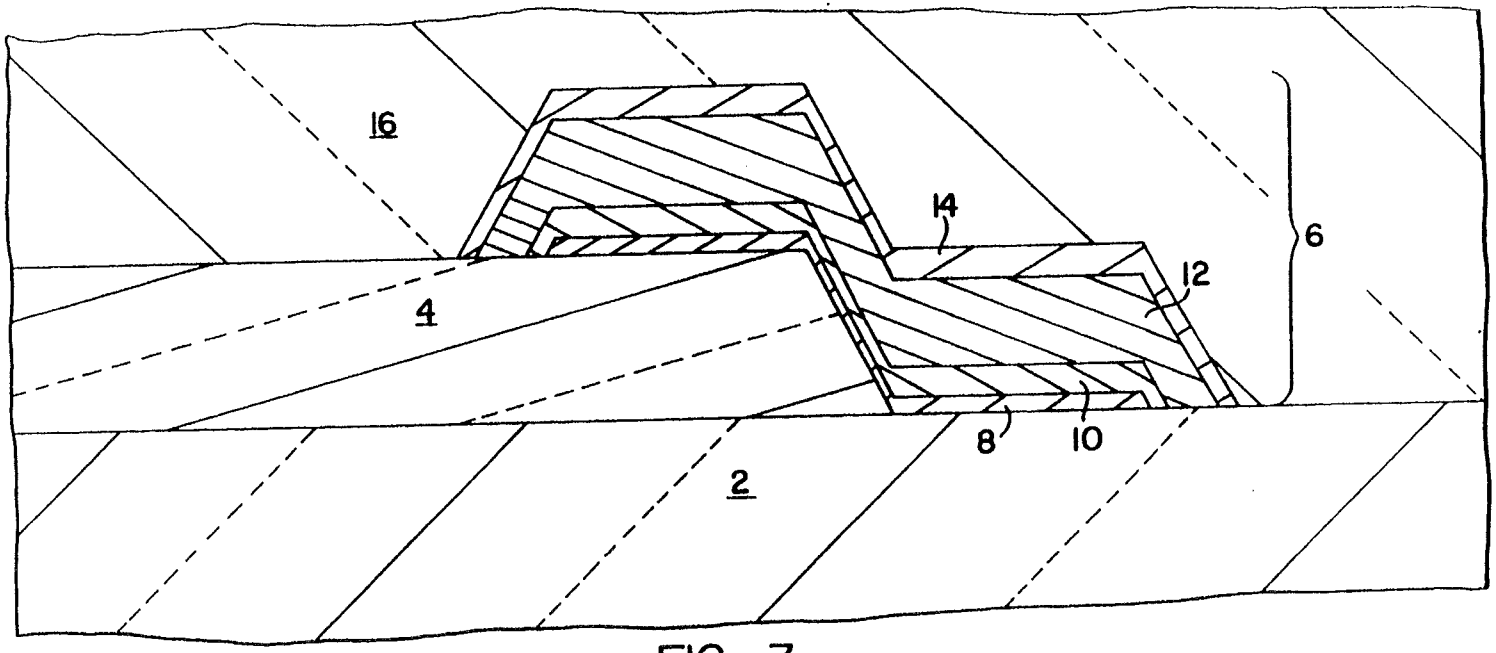
FIG. 3 is an enlarged cross-sectional view of a single ITO line and an associated metal assist structure of the present invention.

In its preferred embodiment, shown in FIG. 3, the metal assist structure 6 is a sandwich of an adhesion layer 8, a first refractory metal layer 10, a primary conductor layer 12, and a second refractory metal layer 14. The adhesion layer 8 promotes the bonding of the metal assist structure 6 to the glass panel 2 and transparent electrode 4. It can include any electrically conductive metal or alloy that can bond to the glass panel 2, transparent electrode 4, and first refractory metal layer 10 without forming stresses that would cause the adhesion layer 8 or any of the other layers to peel away from these structures. Suitable metals include Cr, V, and Ti. Cr is preferred because it evaporates easily and provides good adhesion. Preferably, the adhesion layer 8 will be only as thick as needed to form a stable bond between the structures it contacts. For example, the adhesion layer 8 can be about 10 nm to about 20 nm thick. If the first refractory metal layer 10 can form stable, low stress bonds with the glass panel 2 and transparent electrode 4, the adhesion layer 8 may not be needed. In that case, the metal assist structure 6 can have only three layers: the two refractory metal layers 10, 14 and the primary conductor layer 12.

The refractory metal layers 10, 14 protect the primary conductor layer 12 from oxidation and prevent the primary conductor layer from diffusing into the first dielectric layer 16 and phosphor layer 18 when the ELD is annealed to activate the phosphor layer as described below. Therefore, the refractory metal layers 10, 14 should include a metal or alloy that is stable at the annealing temperature, can prevent oxygen from penetrating the primary conductor layer 12, and can prevent the primary conductor layer 12 from diffusing into the first dielectric layer 16 or the phosphor layer 18. Suitable metals include W, Mo, Ta, Rh, and Os. Both refractory metal layers 10, 14 can be up to about 50 nm thick. Because the resistivity of the refractory layer can be higher than the resistivity of the primary conductor 12, the refractory layers 10, 14 should be as thin as possible to allow for the thickest possible primary conductor layer 12. Preferably, the refractory metal layers 10, 14 will be about 20 nm to about 40 nm thick.

The primary conductor layer 12 conducts most of the current through the metal assist structure 6. It can be any highly conductive metal or alloy such as Al, Cu, Ag, or Au. Al is preferred because of its high conductivity, low cost, and compatibility with later processing. The primary conductor layer 12 should be as thick as possible to maximize the conductivity of the metal assist structure 6. Its thickness is limited by the total thickness of the metal assist structure 6 and the thicknesses of the other layers. For example, the primary conductor layer 12 can be up to about 200 nm thick. Preferably, the primary conductor layer 12 will be about 50 nm to about 180 nm thick.

The ELD of the present invention can be made by any method that forms the desired structures. The transparent electrode 4, dielectric layers 16, 20, phosphor layer 18, and Al lines 22 can be made with conventional methods known to those skilled in the art. The metal assist structure 6 can be made with an etch-back method, a lift-off method, or any other suitable method.

The first step in making an ELD like the one shown in FIG. 2 is to deposit a layer of a transparent conductor on a suitable glass panel 2. The glass panel can be any high temperature glass that can withstand the phosphor anneal step described below. For example, the glass panel can be a borosilicate glass such as Corning 7059 (Corning Glassworks, Corning, N.Y.). The transparent conductor can be any suitable material that is electrically conductive and has a sufficient optical transmittance for a desired application. For example, the transparent conductor can be ITO, a transition metal semiconductor that comprises about 10 mole percent In, is electrically conductive, and has an optical transmittance of about 95% at a thickness of about 300 nm. The transparent conductor can be any suitable thickness that completely covers the glass and provides the desired conductivity. Glass panels on which a suitable ITO layer has already been deposited can be purchased from Donnelly Corporation (Holland, Mich.). The remainder of the procedure for making an ELD of the present invention will be described in the context of using ITO for the transparent electrodes. One skilled in the art will recognize that the procedure for a different transparent conductor would be similar.

ITO electrodes 4 can be formed in the ITO layer by a conventional etch-back method or any other suitable method. For example, parts of the ITO layer that will become the ITO electrodes 4 can be cleaned and covered with an etchant-resistant mask. The etchant-resistant mask can be made by applying a suitable photoresist chemical to the ITO layer, exposing the photoresist chemical to an appropriate wavelength of light, and developing the photoresist chemical. A photoresist chemical that contains 2-ethoxyethyl acetate, n-butyl acetate, xylene, and xylol as primary ingredients is compatible with the present invention. One such photoresist chemical is AZ 4210 Photoresist (Hoechst Celanese Corp., Somerville, N.J.). AZ Developer (Hoechst Celanese Corp., Somerville, N.J.) is a proprietary developer compatible with AZ 4210 Photoresist. Other commercially available photoresist chemicals and developers also may be compatible with the present invention. Unmasked parts of the ITO are removed with a suitable etchant to form channels in the ITO layer that define sides of the ITO electrodes 4. The etchant should be capable of removing unmasked ITO without damaging the masked ITO or glass under the unmasked ITO. A suitable ITO etchant can be made by mixing about 1000 ml $H_2O$, about 2000 ml HCl, and about 370 g anhydrous $FeCl_3$. This etchant is particularly effective when used at about 55° C. The time needed to remove the unmasked ITO depends on the thickness of the ITO layer. For example, a 300 nm thick layer of ITO can be removed in about 2 min. The sides of the ITO electrodes 4 should be chamfered, as shown in the figures, to ensure that the first dielectric layer 16 can adequately cover the ITO electrodes. The size and spacing of the ITO electrodes 4 depend on the dimensions of the ELD. For example, a typical 12.7 cm (5 in) high by 17.8 cm (7 in) wide ELD can have ITO electrodes 4 that are about 30 nm thick, about 250 μm (10 mils) wide, and spaced about 125 μm (5 mils) apart. After etching, the etchant-resistant mask is removed with a suitable stripper, such as one that contains tetramethylammonium hydroxide. AZ 400T Photoresist Stripper (Hoechst Celanese Corp.) is a commercially available product compatible with the AZ 4210 Photoresist. Other commercially available strippers also may be compatible with the present invention.

After forming ITO electrodes 4, layers of the metals that will form the metal assist structure are deposited over the ITO electrodes with any conventional technique capable of making layers of uniform composition and resistance. Suitable methods include sputtering and thermal evaporation. Preferably, all the metal layers will be deposited in a single run to promote adhesion by preventing oxidation or surface contamination of the metal interfaces. An electron beam evaporation machine, such as a Model VES-2550 (Airco Temescal, Berkeley, Calif.) or any comparable machine, that allows for three or more metal sources can be used. The metal layers should be deposited to the desired thickness over the entire surface of the panel in the order in which they are adjacent to the ITO.

The metal assist structures 6 can be formed in the metal layers with any suitable method, including etch-back. Parts of the metal layers that will become the metal assist structures 6 can be covered with an etchant-resistant mask made from a commercially available photoresist chemical by conventional techniques. The same procedures and chemicals used to mask the ITO can be used for the metal assist structures 6. Unmasked parts of the metal layers are removed with a series of etchants in the opposite order from which they were deposited. The etchants should be capable of removing a single, unmasked metal layer without damaging any other layer on the panel. A suitable W etchant can be made by mixing about 400 ml $H_2O$, about 5 ml of a 30 wt % $H_2O_2$ solution, about 3 g $KH_2PO_4$, and about 2 g KOH. This etchant, which is particularly effective at about 40° C., can remove about 40 nm of a W refractory metal layer in about 30 sec. A suitable Al etchant can be made by mixing about 25 ml $H_2O$, about 160 ml $H_3PO_4$, about 10 ml $HNO_3$, and about 6 ml $CH_3COOH$. This etchant, which is effective at room temperature, can remove about 120 nm of an Al primary conductor layer in about 3 min. A commercially available Cr etchant that contains $HClO_4$ and $Ce(NH_4)_2(NO_3)_6$ can be used for the Cr layer. CR-7 Photomask (Cyantek Corp., Fremont, Calif.) is one Cr etchant compatible with the present invention. This etchant is particularly effective at about 40° C. Other commercially-available Cr etchants also may be compatible with the present invention. As with the ITO electrodes 4, the sides of the metal assist structures 6 should be chamfered to ensure adequate step coverage.

The dielectric layers 16, 20 and phosphor layer 18 can be deposited over the ITO lines 4 and metal assist structures 6 by any suitable conventional method, including sputtering or thermal evaporation. The two dielectric layers 16, 20 can be any suitable thickness, such as about 80 nm to about 250 nm thick, and can comprise any dielectric capable of acting as a capacitor to protect the phosphor layer 18 from excessive currents. Preferably, the dielectric layers 16, 20 will be about 200 nm thick and will comprise $SiO_xN_x$. The phosphor layer 18 can be any conventional ELD phosphor, such as ZnS doped with less than about 1% Mn, and can be any suitable thickness. Preferably, the phosphor layer 18 will be about 500 nm thick. After these layers are deposited, the ELD should be heated to about 500° C. for about 1 hour to anneal the phosphor. Annealing causes Mn atoms to migrate to Zn sites in the ZnS lattice from which they can emit photons when excited.

After annealing the phosphor layer 18, metal electrodes 22 are formed on the second dielectric layer 20 by any suitable method, including etch-back or lift-off. The metal electrodes 22 can be made from any highly conductive metal, such as Al. As with the ITO electrodes 4, the size and spacing of the metal electrodes 22 depend on the dimensions of the ELD. For example, a typical 12.7 cm (5 in) high by 17.8 cm (7 in) wide ELD can have metal electrodes 22 that are about 100 nm thick, about 250 μm (10 mils) wide, and spaced about 125 μm (5 mils) apart. The metal electrodes 22 should be perpendicular to the ITO electrodes 4 to form a grid.

Figure 4:
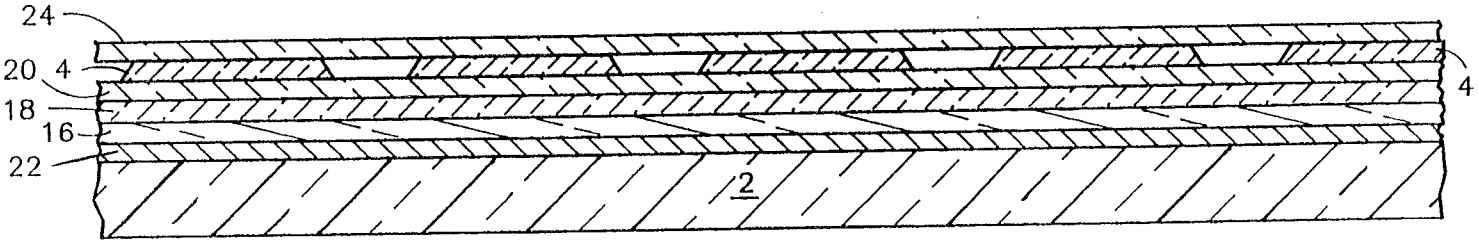
FIG. 4 is a cross-sectional view of an alternate embodiment of an ELD of the present invention.
Figure 5:
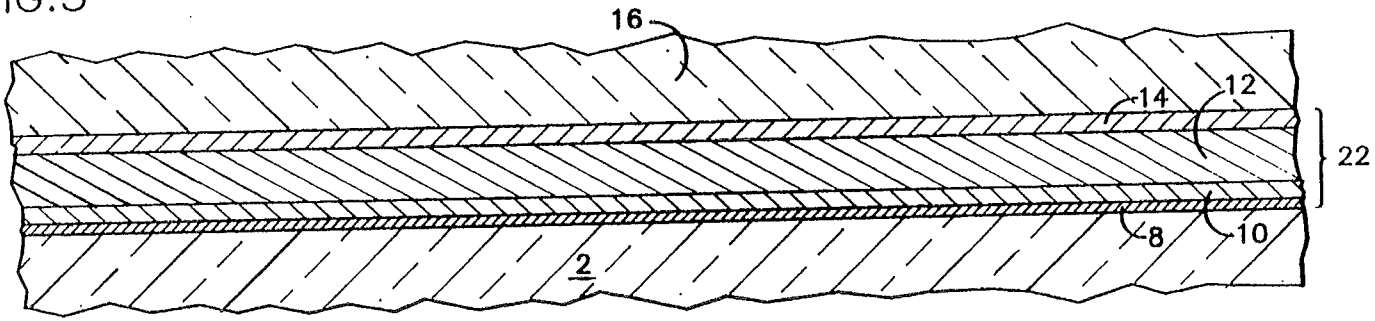
FIG. 5 is an enlarged cross-sectional view of an electrode of the embodiment of FIG. 4.
Figure 6:
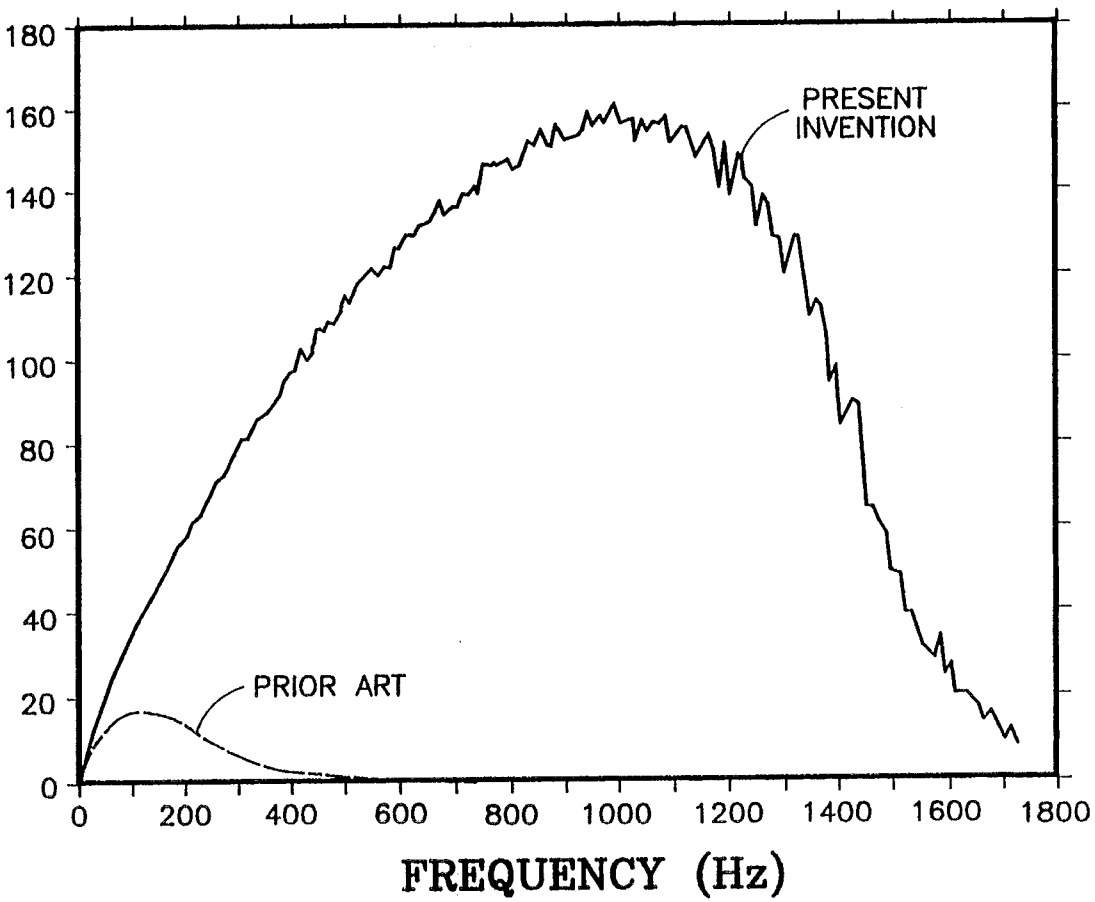
FIG. 6 is a graph of brightness versus frequency for an ELD of the present invention and a prior art ELD.

FIG. 4 shows an alternate embodiment of the present invention in which the metal electrodes 22, rather than the transparent electrodes 4, are formed on a suitable substrate, such as the glass panel 2. In the preferred embodiment, shown in FIG. 5, the metal electrodes 22 are a sandwich of an adhesion layer 8, a first refractory metal layer 10, a primary conductor layer 12, and a second refractory metal layer 14. Each of these layers has the same function as the corresponding layers in the FIG. 3 embodiment. Therefore, they can be made from the same materials as the corresponding layers in the FIG. 3 embodiment. If the first refractory metal layer 10 can form stable, low stress bonds with the glass panel 2, the adhesion layer 8 may not be needed. In that case, the metal electrodes 22 will have only three layers: the two refractory metal layers 10, 14 and the primary conductor layer 12. The remaining structures in the ELD, including a first dielectric layer 16, a phosphor layer 18, and a second dielectric layer 20, are formed above the metal electrodes 22. A plurality of transparent electrodes 4 are formed on the second dielectric layer 20 so they are perpendicular to the metal electrodes 22. In some applications, the transparent electrodes will not need the metal assist structures used in the FIG. 3 embodiment. If a particular application requires metal assist structures, however, they can be included in this embodiment as well. A colored filter 24, such as a glass plate with adjacent red and green stripes, is disposed above the transparent electrodes 4. In this embodiment, the image is viewed from the colored filter 24 side of the ELD, rather than the glass panel 2 side. The colored filter 24 allows a multicolored image, rather than a monochrome image, to be produced. A person skilled in the art will know how to modify the method of making an ELD described above to make an ELD like that shown in FIG. 4. For example, a person skilled in the art will know that the transparent electrodes 4 can be formed on the second dielectric layer 20 after the phosphor layer 18 is annealed.

In addition to the embodiments shown in FIGS. 2 and 4, the ELD of the present invention can have any other configuration that would benefit from the use of the layered metal structures of the present invention.

The following example demonstrates the present invention without limiting the invention's broad scope.

EXAMPLE

A Corning 7059 borosilicate glass panel covered with 300 nm of ITO was purchased from Donnelly Corporation (Holland, Mich.). The panel was 12.7 cm (5 in) high by 17.8 cm (7 in) wide. The ITO was blown with $N_2$ to remove dust, triple solvent cleaned by spraying it in rapid succession with trichloroethylene, acetone, isopropanol, and deionized $H_2O$, scrubbed with SUMMA-CLEAN ® SC-15M cleaner (Mallinckrodt, Inc., Science Products Division, Paris, Ky.), and thoroughly rinsed to remove any organic contaminants. The panel was dried in an 80° C. oven for 30 min and exposed to vapor phase hexamethyl disilane for 15 minutes to promote photoresist adhesion. The cleaned ITO was coated with a layer of AZ 4210 photoresist chemical (Hoechst Celanese Corp., Somerville, N.J) by applying about 40 ml of the photoresist chemical to the panel and spinning the panel for 10 sec at 300 rpm and for 60 sec at 2200 rpm. The panel was baked in an 80° C. oven for about 30 min to dry the photoresist chemical and cooled for about 15 min to a temperature cool to the touch. A pattern of the desired ITO electrodes was placed over the photoresist. The pattern defined 320 electrodes, each 250 μm (10 mils) wide spaced 125 μm (5 mils) apart. The photoresist chemical was then exposed to 405 nm light for 15 sec at 20 mW $cm^{-1}$ and 300 mJ $cm^{-1}$ and immersed in a 50% aqueous solution of AZ Developer (Hoechst Celanese Corp.) to develop the photoresist chemical into an etchant-resistant mask. The panel was baked in a vacuum oven at 120° C. and about 16.7 kPa (25 in Hg below atmospheric) for 30 min to harden the etchant-resistant mask. After drying, the panel was placed in an ITO etchant at 55° C. for 2 min to remove the unmasked ITO. The etchant was made by mixing 1000 ml $H_2O$, 2000 ml HCl, and 370 g anhydrous $FeCl_3$. After removing the unmasked ITO, the panel was soaked in AZ 400-T photoresist stripper (Hoechst Celanese Corp.) for 3 min, scrubbed with cotton balls, thoroughly rinsed with deionized $H_2O$, and scrubbed with SUMMA-CLEAN ® SC-15M cleaner to remove the etchant-resistant mask. After inspecting the panel for flaws, four layers of metals for the metal assist structure were deposited over the ITO electrodes by electron beam evaporation with a Model VES-2550 E-Beam evaporator (Airco Temescal, Berkeley, Calif.). First, a 20 nm thick Cr adhesion layer was deposited over the ITO electrodes and glass. Next, a 40 nm thick W refractory metal layer was deposited over the Cr layer. Then, a 120 nm thick Al primary conductor layer was deposited over the W layer. Finally, a second 40 nm thick W refractory layer was deposited over the Al layer. The panel was scrubbed with SUMMA-CLEAN ® SC-15M cleaner, rinsed thoroughly, and dried in an 80° C. oven for 30 min. After drying, the panel was exposed to vapor phase hexamethyl disilane for 15 minutes to promote photoresist adhesion. About 40 ml of AZ 4210 photoresist chemical were applied to the cleaned metal layers and the panel was spun for 10 sec at 300 rpm and for 60 sec at 2200 rpm to distribute the chemical. The panel was baked in an 80° C. oven for about 30 min to dry the photoresist chemical and cooled for about 15 min to a temperature cool to the touch. A pattern of the desired metal assist structures was placed over the photoresist. The pattern defined 320 metal assist structures, each 50 μm (2 mils) wide, that extended for the full length of the ITO electrodes. The metal assist structures overlapped both the ITO electrodes and glass by 25 μm (1 mil). The photoresist chemical was then exposed to 405 nm light for 17.5 sec at 20 mW $cm^{-2}$ and 350 mJ $cm^{-2}$ and immersed in a 50% aqueous solution of AZ Developer to form an etchant-resistant mask. The panel was baked in a vacuum oven at 120° C. and about 16.7 kPa Torr for 30 min to harden the etchant-resistant mask. After drying, the panel was placed in a W etchant at 40° C. for 30sec to remove unmasked W in the top W layer. The W etchant was made by mixing 400 ml $H_2O$, 5 ml of a 30 wt% $H_2O_2$ solution, 3 g $KH_2PO_4$, and about 2 g KOH. Next, the panel was placed in an Al etchant at room temperature (about 20° C.) for 30 sec to remove unmasked Al in the primary conductor layer. The Al etchant was made by mixing 25 ml $H_2O$, 160 ml $H_3PO_4$, 10 ml $HNO_3$, and 6 ml $CH_3COOH$. Then, the panel was placed back into the W etchant at 40° C. for about 30 sec to remove the next W layer. Finally, the panel was placed into a CR-7 photomask etchant (Cyantek Corp., Fremont, Calif.) at 40° C. until the unmasked areas of the panel became clear. The panel was then soaked in AZ-400T stripper for 1 min and scrubbed with a cotton ball to remove the etchant-resistant mask. A 200 nm thick layer of a $SiO_xN_x$ dielectric was deposited over the metal assist structures, ITO electrodes, and exposed glass by sputtering. A 500 nm thick phosphor layer comprising 99 wt% ZnS doped with 1 wt% Mn was deposited over the $SiO_xN_x$ layer by thermal evaporation. A 200 nm thick layer of a $SiO_xN_x$ dielectric was deposited over the phosphor layer by the same method used to deposit the first $SiO_xN_x$ layer. After the second dielectric layer was deposited, the panel was heated to 500° C. for 1 hour to anneal the phosphor layer. After annealing, a 100 nm thick layer of Al was deposited on the second dielectric layer by sputtering. 240 electrodes, each 274 μm (10.8 mils) wide, were formed from the Al layer by a conventional etch-back method. The Al electrodes were perpendicular to the ITO electrodes to form a grid. After the Al electrodes were formed, various electronic devices that control the ELD were mounted to the ELD and the ELD was tested.

An ELD made by the method detailed in the Example was compared to a prior art ELD. The prior art ELD had ITO transparent electrodes but no metal assist structures on the transparent electrodes. Measurements showed that the ITO electrodes in the prior art device had a resistance of 3100 Ω. By contrast, the transparent electrodes in the ELD of the present invention had a resistance of only 455 Ω. The lower resistance is due entirely to the metal assist structures in the ELD of the present invention. This lower resistance allows the ELD of the present invention to perform significantly better than the prior art device. FIG. 4 shows ELD brightness in foot-Lamberts (f-L) as a function of frequency for the ELD of the present invention (solid line) and the prior art device (dashed line). Data were taken at 20 volts above the threshold voltage, the voltage at which the ELDs had a brightness of 1 f-L. The data show that the ELD of the present invention is significantly brighter than the prior art device at all frequencies. Moreover, the ELD of the present invention can produce a very bright display at frequencies much higher than those at which the prior art device can generate a visible display. These results are directly related to the lower resistance of the transparent electrodes in the ELD of the present invention.

The present invention provides several benefits over the prior art. For example, electrodes made with the metal assist structures of the present invention make ELDs of all sizes brighter. In large ELDs, such as ELDs about 91 cm (36 in) by 91 cm, electrodes with metal assist structures of the present invention can provide enough current to all parts of the panel to provide even brightness across the entire panel. The metal assist structure of the present invention also can be critical to making electrodes narrow enough for ELDs that are about 2.5 cm (1 in) by 2.5 cm or smaller with high pixel density. In addition, the layered design of the metal assist structures and metal electrodes of the present invention permits these structures to withstand the phosphor anneal without oxidizing or contaminating other structures in the ELD.

The invention is not limited to the particular embodiments shown and described herein. Various changes and modifications may be made without departing from the spirit or scope of the claimed invention.

We claim:

1. A method of making an electroluminescent display that includes a transparent electrode, comprising:

forming a metal assist structure over the transparent electrode, wherein the metal assist structure comprises a first refractory metal layer, a primary conductor layer formed on the first refractory metal layer, and a second refractory metal layer formed on the primary conductor layer such that the first and second refractory metal layers are capable of protecting the primary conductor layer from oxidation when the electroluminescent display is annealed to activate a phosphor layer.

2. The method of claim 1, wherein the metal assist structure is formed by:

(a) sequentially depositing a first layer of a refractory metal, a layer of an electrically conductive metal or alloy, and a second layer of a refractory metal over the transparent electrode, and (b) sequentially removing portions of each layer deposited in step (a) to create the metal assist structure with a desired geometry.

3. The method of claim 1, wherein the transparent electrode is first formed on a glass panel and the metal assist structure is also formed over a portion of the glass panel.

4. The method of claim 1, wherein the metal assist structure covers about 10% or less of the transparent electrode.

5. The method of claim 1, wherein the refractory metal comprises a material selected from the group consisting of W, Mo, Ta, Rh, and Os.

6. The method of claim 1, wherein the first and second refractory metal layers are each about 20 nm to about 40 nm thick.

7. The method of claim 1, wherein the primary conductor comprises a material selected from the group consisting of Al, Cu, Ag, and Au.

8. The method of claim 1, wherein the primary conductor layer is about 50 nm to about 260 nm thick.

9. The method of claim 1, wherein the metal assist structure is formed by:

(a) sequentially depositing an adhesion layer, a first layer of a refractory metal, a layer of an electrically conductive metal or alloy, and a second layer of a refractory metal over the transparent electrode, and (b) sequentially removing portions of each layer deposited in step (a) to create the metal assist structure with a desired geometry.

10. The method of claim 9, wherein the adhesion layer comprises a material selected from the group consisting of Cr, V, and Ti.

11. The method of claim 9, wherein the adhesion layer is about 10 nm to about 20 nm thick.

12. The method of claim 9, wherein the transparent electrode is indium-tin oxide, the adhesion layer is Cr, the first and second refractory metal layers are W, and the primary conductor layer is Al.

13. A method of making an electroluminescent display from a glass panel covered with a layer of indium-tin oxide, comprising:

(a) forming a plurality of indium-tin oxide electrodes from the indium-tin oxide layer by etching away portions of the indium-tin oxide layer with an etchant equivalent to a solution of about 1000 ml $H_2O$, about 2000 ml HCl, and about 370 g anhydrous $FeCl_3$, (b) sequentially depositing a layer of Cr, a first layer of W, a layer of Al, and a second layer of W over the indium-tin oxide electrodes, (c) etching away portions of the second W layer with an etchant equivalent to a solution of about 400 ml $H_2O$, about 5 ml of a 30 wt% $H_2O_2$ solution, about 3 g $KH_2PO_4$, and about 2 g KOH, (d) etching away portions of the Al layer with an etchant equivalent to a solution of about 25 ml $H_2O$, about 160 ml $H_3PO_4$, about 10 ml $HNO_3$, and about 6 ml $CH_3COOH$, (e) etching away portions of the first W layer with an etchant equivalent to a solution of about 400 ml $H_2O$, about 5 ml of a 30 wt% $H_2O_2$ solution, about 3 g $KH_2PO_4$, and about 2 g KOH, and (f) etching away portions of the Cr layer with an etchant that comprises $HClO_4$ and $Ce(NH_4)_2(NO_3)_6$, wherein steps (c), (d), (e), and (f) form a metal assist strip on each indium-tin oxide electrode.

14. A method of making an electroluminescent display, comprising:

forming a metal electrode on a substrate, wherein the metal electrode comprises a first refractory metal layer, a primary conductor layer formed on the first refractory metal layer, and a second refractory metal layer formed on the primary conductor layer such that the first and second refractory metal layers are capable of protecting the primary conductor layer from oxidation when the electroluminescent display is annealed to activate a phosphor layer.

15. The method of claim 14, wherein the metal electrode is formed by:

(a) sequentially depositing a first layer of a refractory metal, a layer of an electrically conductive metal or alloy, and a second layer of a refractory metal over the transparent electrode, and (b) sequentially removing portions of each layer deposited in step (a) to create the metal electrode with a desired geometry.

16. The method of claim 14, wherein the refractory metal comprises a material selected from the group consisting of W, Mo, Ta, Rh, and Os.

17. The method of claim 14, wherein the first and second refractory metal layers are each about 20 nm to about 40 nm thick.

18. The method of claim 14, wherein the primary conductor comprises a material selected from the group consisting of Al, Cu, Ag, and Au.

19. The method of claim 14, wherein the primary conductor layer is about 50 nm to about 260 nm thick.

20. The method of claim 14, wherein the metal electrode is formed by:

(a) sequentially depositing an adhesion layer, a first layer of a refractory metal, a layer of an electrically conductive metal or alloy, and a second layer of a refractory metal over the transparent electrode, and (b) sequentially removing portions of each layer deposited in step (a) to create the metal electrode with a desired geometry.

21. The method of claim 14, wherein the adhesion layer comprises a material selected from the group consisting of Cr, V, and Ti.

22. The method of claim 20, wherein the adhesion layer is about 10 nm to about 20 nm thick.

23. The method of claim 20, wherein the adhesion layer is Cr, the first and second refractory metal layers are W, and the primary conductor layer is Al.

24. A method of making an electroluminescent display, comprising:

(a) sequentially depositing a layer of Cr, a first layer of W, a layer of Al, and a second layer of W over a substrate, (b) etching away portions of the second W layer with an etchant equivalent to a solution of about 400 ml $H_2O$, about 5 ml of a 30 wt% $H_2O_2$ solution, about 3 g $KH_2PO_4$, and about 2 g KOH, (c) etching away portions of the Al layer with an etchant equivalent to a solution of about 25 ml $H_2O$, about 160 ml $H_3PO_4$, about 10 ml $HNO_3$, and about 6 ml $CH_3COOH$, (d) etching away portions of the first W layer with an etchant equivalent to a solution of about 400 ml $H_2O$, about 5 ml of a 30 wt% $H_2O_2$ solution, about 3 g $KH_2PO_4$, and about 2 g KOH, and (e) etching away portions of the Cr layer with an etchant that comprises $HClO_4$ and $Ce(NH_4)_2(NO)_3)_6$, wherein steps (b), (c), (d), and (e) form a plurality of metal electrodes on the substrate.

* * * * *